US006092894A

United States Patent [19]

Nuita et al.

[11] Patent Number: 6,092,894

[45] Date of Patent: Jul. 25, 2000

[54] PRINTING MEDIUM HOLDING APPARATUS FOR A PRINTER USING AIR SUCTION FORCE

[75] Inventors: Akira Nuita, Shizuoka-ken; Yasuhiro Suzuki, Numazu; Tadao Kamano, Shizuoka-ken; Shinichiro Fujii, Mishima; Masaaki Oyaide, Shizuoka-ken; Hiroshi Yamaguchi, Numazu, all of Japan

[73] Assignee: Toshiba Tec Kabushiki Kaisha, Tokyo, Japan

[21] Appl. No.: 08/985,025

[22] Filed: Dec. 4, 1997

[30] Foreign Application Priority Data

| | | | |
|---|---|---|---|
| Dec. 5, 1996 | [JP] | Japan | 8-324999 |
| Dec. 5, 1996 | [JP] | Japan | 8-325000 |
| Dec. 19, 1996 | [JP] | Japan | 8-340101 |
| Jan. 7, 1997 | [JP] | Japan | 9-000453 |

[51] Int. Cl.[7] ..... B41J 2/01; B65H 5/22

[52] U.S. Cl. ..... 347/104; 271/3.22; 271/196; 271/276

[58] Field of Search ..... 347/16, 101, 104; 271/3.21, 3.22, 196, 276

[56] References Cited

U.S. PATENT DOCUMENTS

| | | | |
|---|---|---|---|
| 4,101,018 | 7/1978 | Sokolowski | 347/104 X |
| 4,237,466 | 12/1980 | Scranton | 271/276 X |
| 4,550,999 | 11/1985 | Anderson | 271/276 X |
| 4,660,825 | 4/1987 | Umezawa | 271/276 |
| 4,662,622 | 5/1987 | Wimmer et al. | 271/196 X |
| 4,982,207 | 1/1991 | Tunmore et al. | 271/196 X |
| 5,329,301 | 7/1994 | Balzeit et al. | 271/276 X |

FOREIGN PATENT DOCUMENTS

| | | | |
|---|---|---|---|
| 55-87564 | 7/1980 | Japan | 347/104 |
| 57-174285 | 10/1982 | Japan . | |
| 6-99575 | 4/1994 | Japan | 347/101 |
| 8-269959 | 11/1996 | Japan . | |

*Primary Examiner*—Susan S. Y. Lee

*Attorney, Agent, or Firm*—Frishauf, Holtz, Goodman, Langer & Chick, P.C.

[57] ABSTRACT

Suction ports (14) are provided in one end (15R) of a drum (10), connecting the interior (16) and exterior of the drum (10). Corresponding suction ports (34) are provided at a stationary side (5R), opposing the suction ports (14), respectively. A suction fan (32) is provided, which draws air from the interior (16) of the rotating drum (10) through the corresponding suction ports (34) and the suction ports (14). A printing medium M can be attracted and held onto the outer circumferential surface (11) of the drum (10) by virtue of negative pressure, by utilizing the negative pressure generated in the interior (16) of the drum (10) as the suction fan (32) rotates and a plurality of suction holes (12) extending in a radial direction and connecting the interior and exterior of the drum (10). A damper (38) is provided at the air outlet port of the suction fan (32), for opening and closing the outlet port of the fan (32).

14 Claims, 10 Drawing Sheets

PRINTING MEDIUM HOLDING APPARATUS FOR A PRINTER USING AIR SUCTION FORCE

BACKGROUND OF THE INVENTION

The present invention relates to an apparatus for holding a printing medium in a printer, such as an ink jet printer, which can apply ink from ink jet nozzles onto the printing medium, such as a paper sheet, held on a drum rotating at a prescribed circumferential speed and thus rotating together with the drum and which can thereby perform printing.

A so-called serial-type ink jet printer is known. In this printer, the nozzle units for respective colors are repeatedly moved back and forth in the line direction. While moving along each line, the nozzle units print one line on a printing medium. Every time one line is printed, the printing medium (an ordinary paper sheet or an OHP sheet) is fed forward by line one.

An ink jet printer is known in Japanese Patent Application No. 8-296959 filed by the assignee of the present patent application. This ink jet printer can effect printing at a speed much higher than the serial-type ink jet printer and can continuously print a number of pages. Further, it can be much smaller than so-called laser printers.

In order to increase the printing speed of an ink jet printer, it is necessary to hold a printing medium quickly and reliably on the circumferential surface of the drum, while keeping the drum rotating, that is, without stopping the drum. It is also necessary to release the printing medium from the drum after the printing has been accomplished.

The object of the present invention is to provide an apparatus for use in a printer, which can hold a printing medium on the drum quickly and reliably and can release the medium from the drum after printing has been carried out.

BRIEF SUMMARY OF THE INVENTION

According to the present invention there is provided an apparatus for holding a printing medium in a printer which can apply ink from ink jet nozzles onto the printing medium held on a drum rotating at a prescribed circumferential speed and thus rotating together with the drum and which can thereby effect printing. The apparatus has a plurality of suction ports made in one end of the drum and connecting the interior of the drum to the exterior thereof; corresponding suction ports provided at a stationary side and opposing the suction ports; and a suction fan for drawing air from the interior of the rotating drum through the corresponding suction port and the suction port. The apparatus is characterized in that the negative pressure generated in the drum as the suction fan rotates and a plurality of suction holes extending in a radial direction and connecting the interior and exterior of the drum are utilized to attract and hold a printing medium onto the outer circumferential surface of the drum.

In the present invention, air is drawn from the interior of the drum via each suction port and the corresponding suction port when the suction fan is rotated as the printing medium is supplied to the rotating drum. A negative pressure is thereby generated in the drum. Once the printing medium has reached a position where it opposes the suction holes of the drum, it is held due to the negative pressure applied to it through the suction holes. The printing medium is therefore held onto the outer circumferential surface of the rotating drum quickly and reliably.

To release the printing medium after printing, the negative pressure in the drum is eliminated. The medium is then no longer held by virtue of a negative pressure.

According to the present invention, there is provided an apparatus for holding a printing medium in a printer, which comprises a damper which is located the air outlet side of the suction fan and which can open and close the outlet port of the fan.

In this invention, when the damper closes the outlet port of the suction fan, air is no longer drawn from the interior of the drum. Hence, no negative pressure acts on the printing medium, and the printing medium is no longer held on the drum. When the damper opens the outlet port of the suction fan, air is drawn from the interior of the drum. The printing medium is held onto the outer circumferential surface of the drum due to the negative pressure applied to the medium via the suction holes. The printing medium can therefore be held onto and released from the outer circumferential surface of the drum even more quickly.

DETAILED DESCRIPTION OF THE INVENTION

Embodiments of the present invention will now be described, with reference to the accompanying drawings.

Figure 1:
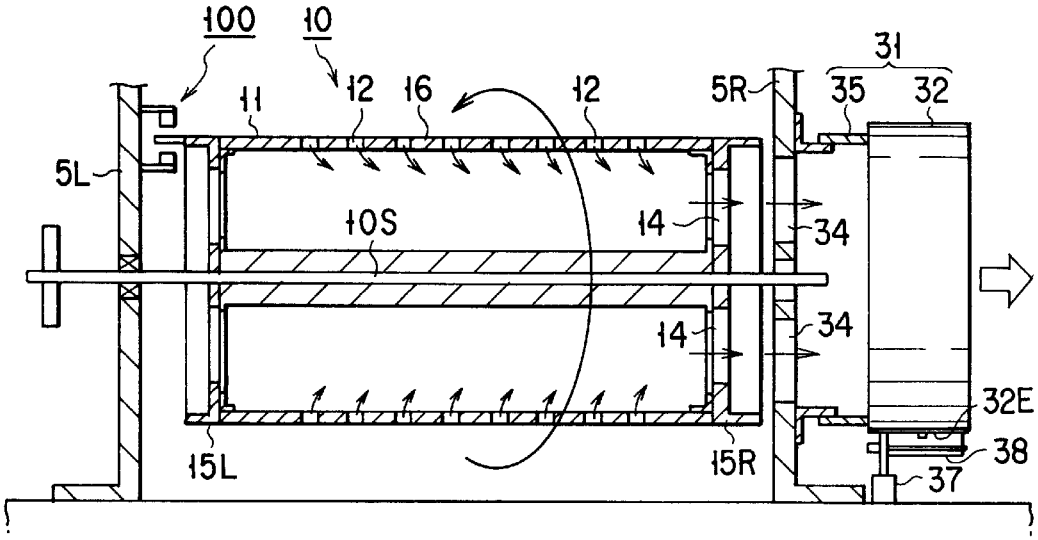
FIG. 1 is a view showing an embodiment of the present invention.
Figure 2:
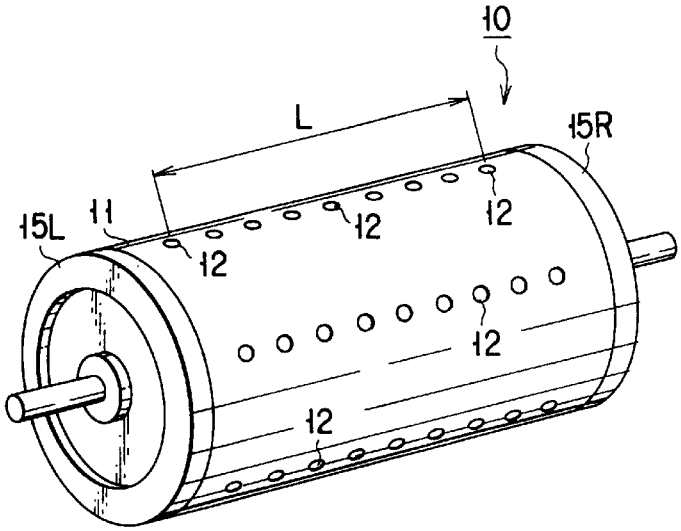
FIG. 2 is a view for explaining the suction holes of the embodiment.

As shown in FIGS. 1 and 2, the medium holding apparatus of an ink jet printer according to an embodiment of the invention has a plurality of suction holes 12, suction ports 14 made in a drum 10, corresponding suction ports 34 made in a stationary frame 5R, and a suction fan 32. It is designed to hold a printing medium M such as a paper sheet on the outer circumferential surface of the drum 10 by virtue of a negative pressure.

The structure and operation of the ink jet printer to which this embodiment is applied will be described briefly, with reference to FIG. 4.

Figure 4:
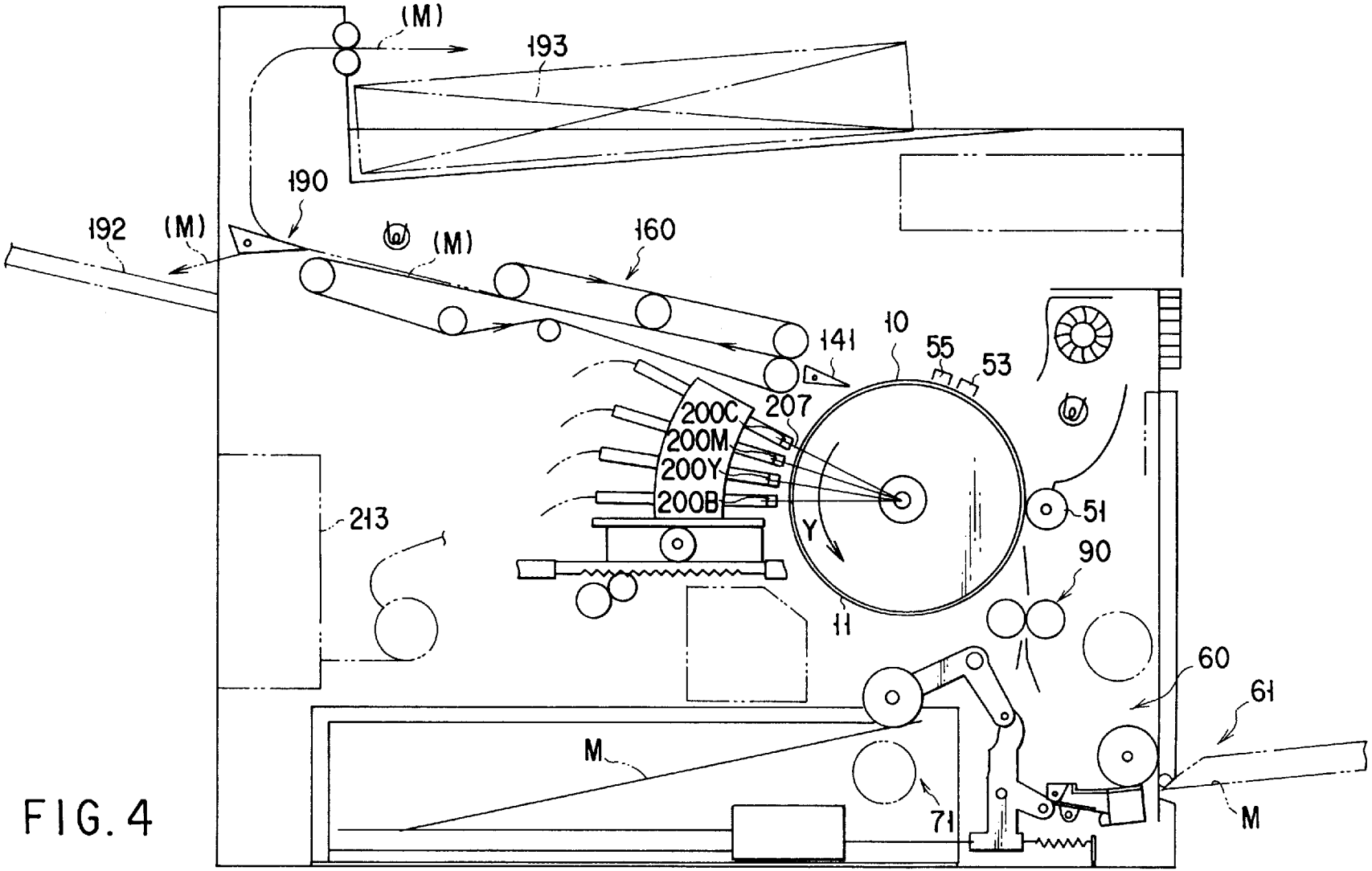
FIG. 4 is a view for explaining the charging means used as an auxiliary means in the embodiment.

In the apparatus of FIG. 4, the drum 10 can rotate at a prescribed circumferential speed. It can hold a printing paper sheet, i.e., a printing medium M, on its outer circumferential surface 11. Nozzle units 200C, 200M, 200Y and 200B for cyan, magenta, yellow and black, respectively, are arranged in the direction Y in which the drum 10 rotates.

Hence, printing is effected in the line direction as each one-piece nozzle unit for one color is moved back and forth over an entire line (extending perpendicular to the plane of the paper speed), or each one-piece nozzle unit for one color, having a plurality of nozzle unit elements arranged in the line direction, is moved back and forth for a nozzle-pitch distance, while the ink jet nozzles 207 for each color applies ink onto the printing medium M. Further, printing can be achieved in the column direction as the drum 10 is rotated while each nozzle unit is moving back and forth for a nozzle-pitch distance.

Namely, printing can be accomplished in the line direction and the column direction at the same time.

Therefore, it can be performed at a very high speed.

Since each of the nozzle units 200C to 200B for colors and the ink tank (ink cassette) 213 containing ink of a specific color are provided at positions far from each other, the nozzle unit can be made light and can be moved back and forth at a very high speed, helping increase the printing speed, and the volume of the ink tank 213 (ink cassette) can be increased so that printing can be continuously effected on 500 sheets or more.

To accomplish this, a supplying mechanism 60 and a medium supplying mechanism 90 are provided at one side (the right side in the figure) of the drum 10, and a medium peeling mechanism 141, a medium discharging mechanism 160, and direction switching means 190 are provided on the other side (the left side) of the drum 10.

The supplying mechanism 60 can supply printing media M, one by one, from either a cassette feeding mechanism 71 or a manual feeding mechanism 61. The medium supplying mechanism 90 supplies a printing media M supplied to it, toward the drum 10 at predetermined timing. The medium peeling mechanism 160 peels a printing medium M from the drum 10 after printing. The medium discharging mechanism 160 transports a medium M peeled, to the left in FIG. 4. The direction switching mechanism 190 selects either a discharge tray 192 or an upper discharge tray 193.

Thus, printing media M can be fed, supplied, held, printed, peeled and discharged continuously. Multi-color printing can therefore be performed on, for example, 20 A4-size printing media M or more per minute.

Referring back to FIGS. 1 and 2, the suction holes 12 are made in all outer circumferential surface 11 of the drum 10, each connecting the interior and exterior of the drum 10. In the present embodiment, as shown in FIG. 2, the suction holes 12 are formed in a region having a width less than the width (L) of the smallest printing medium M that may be used.

Each of the suction ports 14 is provided in one end (end plate 15R) of the drum 10, connecting the interior 16 and exterior of the drum 10. The corresponding suction ports 34 oppose the suction ports 14, respectively, and made in a bracket 5R provided in a main-body case 1. The drum 10 (15R) and a negative pressure generating means 31 (5R) are aligned along the axis of the drum. They are located close to each other, not contacting each other. The other end plate 15L is a blind patch.

The suction fan 32 is means for generating a negative pressure in the interior 16 by drawing air from the interior 16 of the rotating drum 10 through the corresponding suction ports 34 and each suction port 14. In this embodiment, the suction ports 34 of the bracket 5R are connected to the suction fan 32 by a duct 35. The suction fan 32, the duct 35 and the like constitute the negative pressure generating means 31. In FIG. 1, symbol 10S denotes the shaft of the drum 10, and numeral 100 designates the sensor for detecting the position that the drum 10 takes in its rotating direction.

The present embodiment has a damper 38 that can open and close the outlet port 32E for discharging the air the suction fan 32 has drawn. The damper 38 is opened and closed by means of a damper opening/closing mechanism 37.

Figure 3:
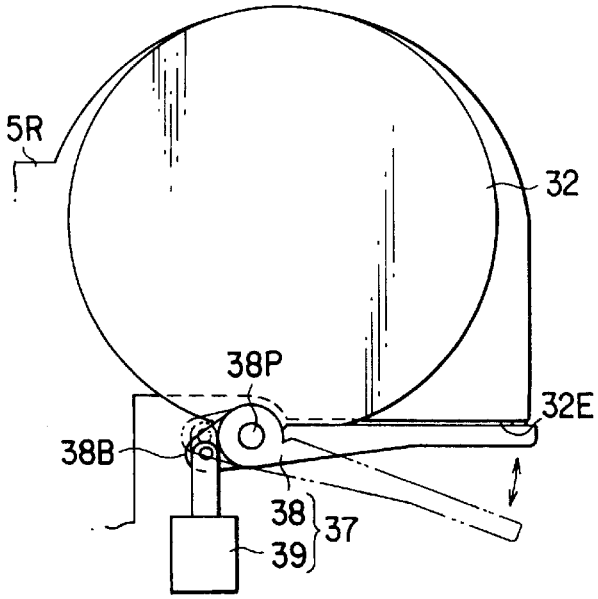
FIG. 3 is a view for explaining the damper of the embodiment.

The damper 38 is located below the suction fan 32 and is supported by a pin 39P so as to be rotated. As shown in FIG. 3, the damper opening/closing mechanism 37 comprises an actuator 39, which is connected to the rear end 38B of the damper 38.

The outlet port 32E of the suction fan 32 is opened when the actuator 39 is open-driven, rotating the damper 38 in clockwise direction from the closed position indicated by solid lines in FIG. 3. The outlet port 32E of the suction fan 32 is closed when the actuator 39 is close-driven, rotating the damper 38 in counterclockwise direction back to the closed position indicated by solid lines in FIG. 3. If the outlet port 32E is closed while the suction fan 32 is rotating, the suction of air from the interior 16 of the drum 16 will be stopped.

Electrostatic holding as an auxiliary function is performed by a charging roller 51 shown in FIG. 4, which is a charging roller. The printing medium M is positively charged and attracted to the outer circumferential surface of the drum 10, by virtue of the electrostatic attraction generated between the medium M and the drum 10 connected to the ground. An auxiliary charging device 53 is provided to compensate for a decrease in the electrostatic attraction which occurs during the printing.

After printing, a charge-removing device 55 applies an electric charge of the polarity opposite to that of the charge applied by the charging means 51, thereby eliminating the charge for attracting the medium M.

Further, a claw-type holding mechanism 41 used as auxiliary means is provided. As shown in FIGS. 5A and 5B and FIGS. 6A and 6B, the holding mechanism 41 includes a holding claw 42, a normally holding mechanism 43, a normally releasing lock mechanism 44, a lock releasing mechanism 45, and a lock resetting mechanism 46. The holding claw 42, the normally holding mechanism 43, and the normally releasing lock mechanism 44 are attached to one end of the drum 10 which is the movable side. The lock releasing mechanism 45 and the lock resetting mechanism 46 are attached to the bracket (not shown) which is provided in the main-body case 1 and which is the stationary side.

The lock releasing mechanism 45 and the lock resetting mechanism 46 cooperate with the normally holding mechanism 43 and the normally releasing lock mechanism 44 to hold and release the holding claw 42, making good use of the rotation of the drum 10.

Figure 5A:
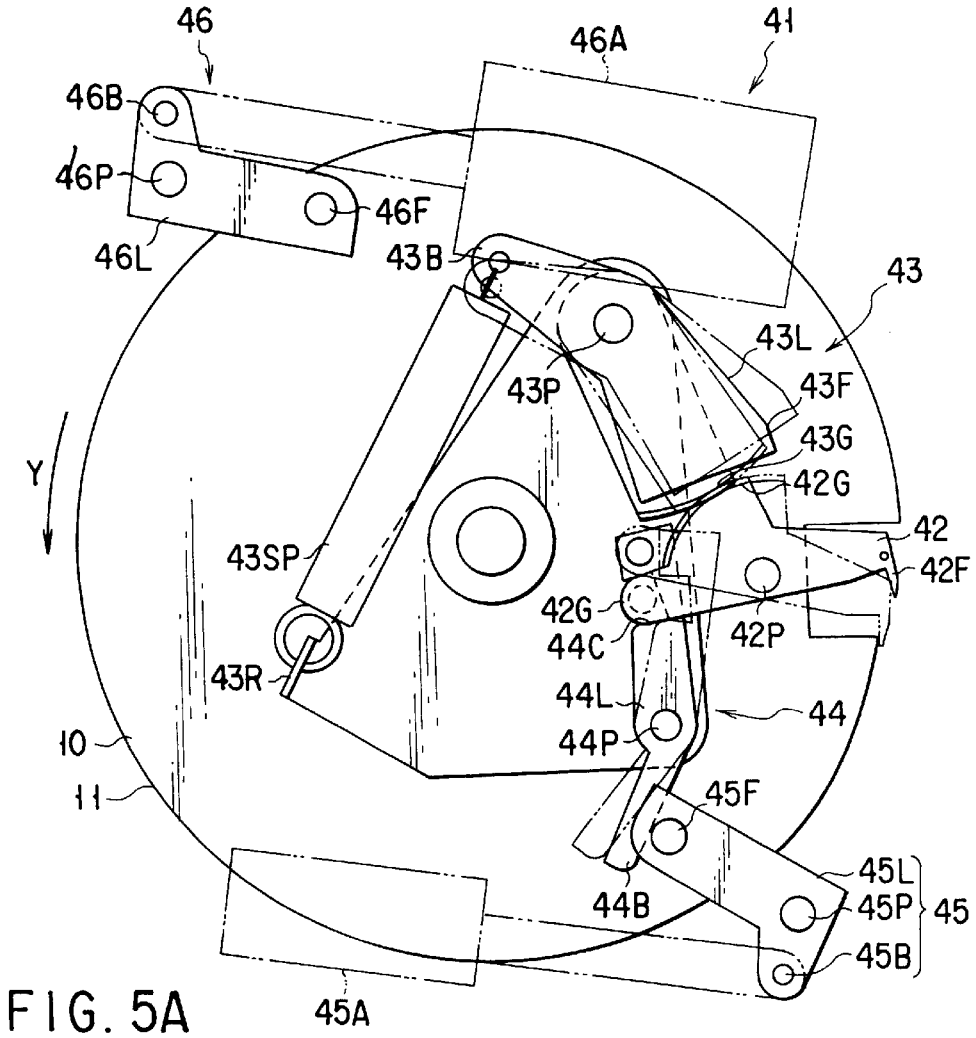
FIGS. 5A and 5B are views explaining how the holding claw used as auxiliary means is closed.
Figure 5B:
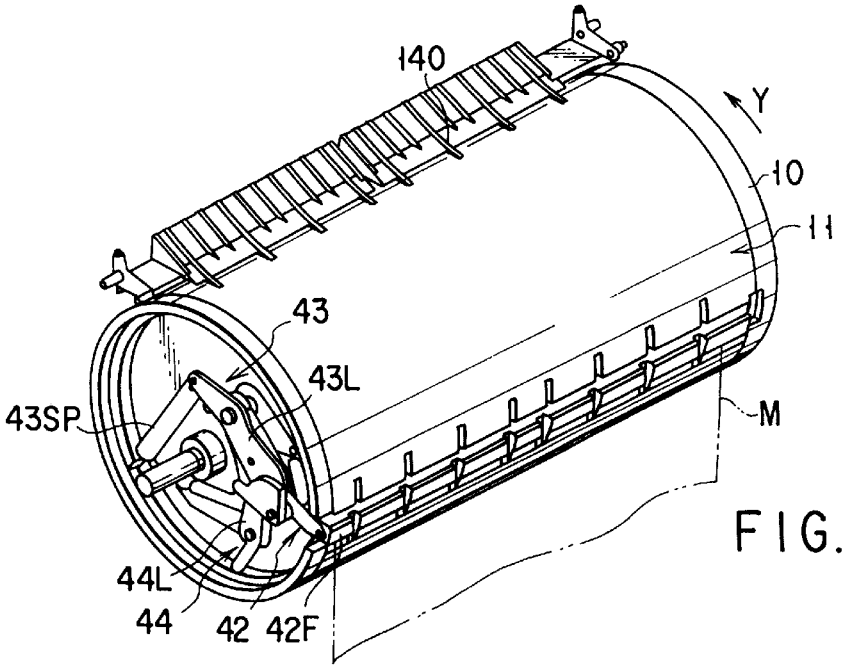

The holding claw 42 is designed to hold the printing medium M on the outer circumferential surface 11 of the drum 10. More specifically, the holding claw 42 has a claw 42F, an engagement section 42C and a sector gear 42G as is illustrated in FIGS. 5A and 5B. It can rotate around a pin 42P. The claw 42F holds an edge of the printing medium M (e.g., the leading edge) onto the outer circumferential surface 11 of the drum 10.

The normally holding mechanism 43 comprises a lever 43L, a sector gear 43G, and a spring 43S.

The lever 43L (proximal section 43B, distal section 43F) can rotate around 43P. The sector gear 43G is secured to the distal end 43F and set into engagement with the sector gear 42G. The spring 43S is stretched between the proximal end 43B and a fixed section 43. The force normally releasing lock mechanism 44of the spring 43S (a pulling force) is used, normally maintaining the holding claw 42 in the holding position indicated by two-dotted, dashed lines in FIG. 5A.

The normally releasing lock mechanism 44 comprises a lock lever 44L. The lock lever 44L can rotate around a pin 44P. The engagement groove 44C of the lock lever 44L can hold and release the engagement section 42C of the holding claw 42. The mutual engagement of the groove 44C and the section 42C locks the holding claw 42 normally in the releasing state indicated by the solid lock releasing mechanism 45 lines in FIG. 5A.

The lock releasing mechanism 45 comprises a lever 45L and an actuator 45A. The lever 45L (distal section 45F, proximal section 45B) can rotate around a pin 45P provided at the stationary side. When the actuator 45A rotates the lever 45L clockwise around the pin 45P, the distal section 45F composed of a pin comes into engagement with the proximal section 44B of the lock lever 44L which has come as the drum 10 rotates. The lock lever 44L is thereby rotated clockwise, coming out of the engagement with the holding claw 42 (42C). As a result, the holding claw 42 receives the bias of the spring 43S and can therefore hold the medium M. That is, the claw 42 can be released from the normally releasing lock state.

As shown in FIG. 5A, the lock resetting mechanism 46 comprises a lever 46L (distal section 46F, proximal section 46B) and an actuator 46A. The lever 46L can rotate around a pin 46P provided at the stationary side. When the actuator 46A rotates the lever 46L clockwise around the pin 46P, the distal end 46F composed of the pin of the lever 46L can push the lever 43L which has come as the drum 10 rotates. Further, it can set the holding claw 42 in the hold-releasing state indicated by two-dot, dashed line, by way of the sector gears 43G and 42G. Hence, the engagement section 42C of the holding claw 42 comes into engagement with the lock lever 44L (44F). In other words, the holding claw 42 can be set back into the normally holding lock state.

The operation of the present embodiment will now be explained.

When the suction fan 32 is rotated as a printing medium M is supplied to the rotating drum 10, the air in the interior 16 of the drum is drawn therefrom through the suction ports and the corresponding suction ports 34. A negative pressure is thereby generated in the interior 16 of the drum.

The printing medium M which has reached a position where it opposes the suction holes 12 made in the outer circumferential surface 11 of the drum is attracted to and held due to the negative pressure applied through the suction holes 12. Thus, the printing medium M is held onto the outer circumferential surface 11 of the rotating drum, both quickly and reliably.

Meanwhile, the printing medium M has its leading edge held by the holding claw 42 of the claw-type holding mechanism 41 and is electrostatically attracted to the outer circumferential surface 11 of the drum by a charging device 50 or the like. The medium M is therefore held on the outer circumferential surface 11 of the drum, more reliably and steadily than otherwise.

The ink jet nozzles 207, each provided for one color, apply inks to the printing medium M held on the outer circumferential surface 11 of the drum. Color printing is thereby accomplished.

After the color printing, the drawing of air effected by the suction fan 32 is stopped. The printing medium M is therefore no longer attracted by virtue of the negative pressure. At the same time the printing medium M is released from the attracted state, it is released also from the mechanical holding achieved by the claw-type holding mechanism 41.

As mentioned above, the present embodiment has a plurality of suction holes 12, suction ports 14 made in a drum 10, corresponding suction ports 34 made in a stationary frame 5R, and a suction fan 32. The embodiment is designed to attract a printing medium M onto the outer circumferential surface 11 of the drum. The embodiment can therefore hold the printing medium M onto the rotating drum 10 quickly and reliably, and can release the printing medium M therefrom after printing.

Since the damper 38 which can open and close the outlet port 32E of the suction fan 32 is provided, the printing medium M can be held onto the drum 10 and released therefrom more quickly than otherwise.

Further, since the drum 10 (15R) and the negative pressure generating mechanism 31 (5R) do not contact, the load applied on the drum 10 while the drum 10 is rotating can be small. This ensures smooth rotation of the drum 10. The gap between the components 15R and 5R serves to reduce the difference between the load applied on the suction fan 32 when the printing medium M is held by the negative pressure and the load applied on the fan 32 when printing medium M is not so held.

As mentioned above, the charging means 51 is provided as an auxiliary means for electrostatically attracting the printing medium M to the drum 10, and the claw-type holding mechanism 41 holds the leading edge of the printing medium M. Therefore, the printing medium M can be held more steadily and reliably than otherwise.

As described above, this embodiment comprises a plurality of suction holes and suction ports provided in the drum, corresponding suction ports provided at the stationary side, and a suction fan. The embodiment is designed to hold a printing medium M on the outer circumferential surface of the drum by virtue of a negative pressure. This is accomplished by utilizing the negative pressure generated in the drum as the drum is rotated and the suction holes extending in the radial direction of the drum, each connecting the interior and exterior of the drum. Hence, the embodiment can hold the printing medium onto the rotating drum fast and reliably and can release the medium from the drum after printing.

Since the damper which can open and close the outlet port is provided at the air outlet side of the suction fan, the embodiment can hold the printing medium M onto the drum 10 and release the same therefrom even faster than otherwise.

Another embodiment of the present invention will be described below, with reference to FIGS. 7A to FIG. 9.

As shown in FIGS. 7A to 9, the ink jet printer according to this embodiment comprises a plurality of negative pressure generating chambers 16-1, 16-2 and 16-3, suction holes 12, suction ports 14 and a plurality of shutters 18, all provided at the drum 10. The printer further comprises an open/close mechanism 25 and a suction fan 32 at the stationary side. The shutters 18 are opened sequentially, from the down-stream of the direction Y in which a drum 10 is rotated. Negative pressures can thereby be generated in the negative pressure generating chamber 16-1, 16-2 and 16-3, in the order opposite to the direction in which the chambers are arranged in the rotating direction Y.

Figure 7A:
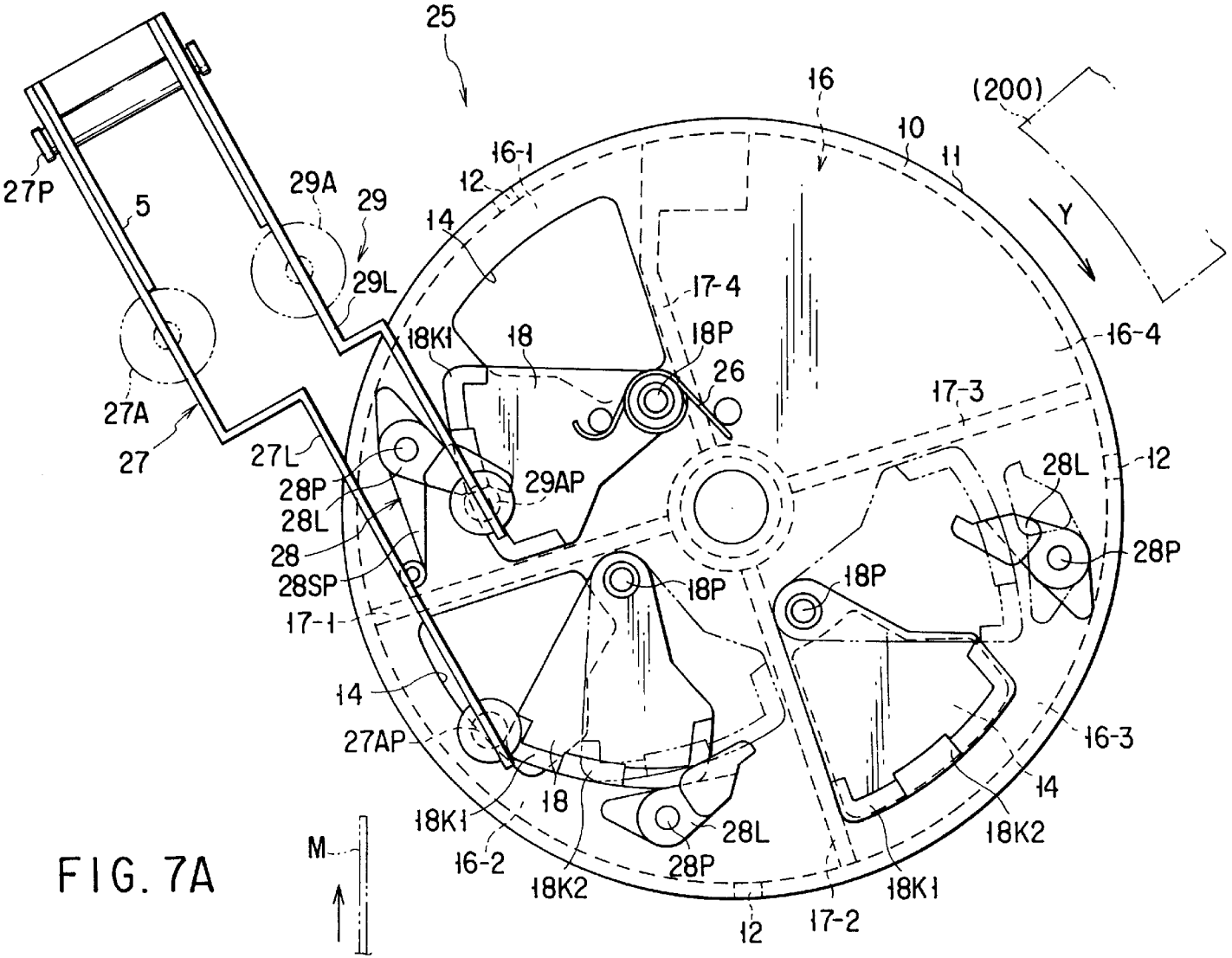
FIGS. 7A and 7B are views illustrating one end of the drum incorporated in another embodiment of the invention.
Figure 7B:
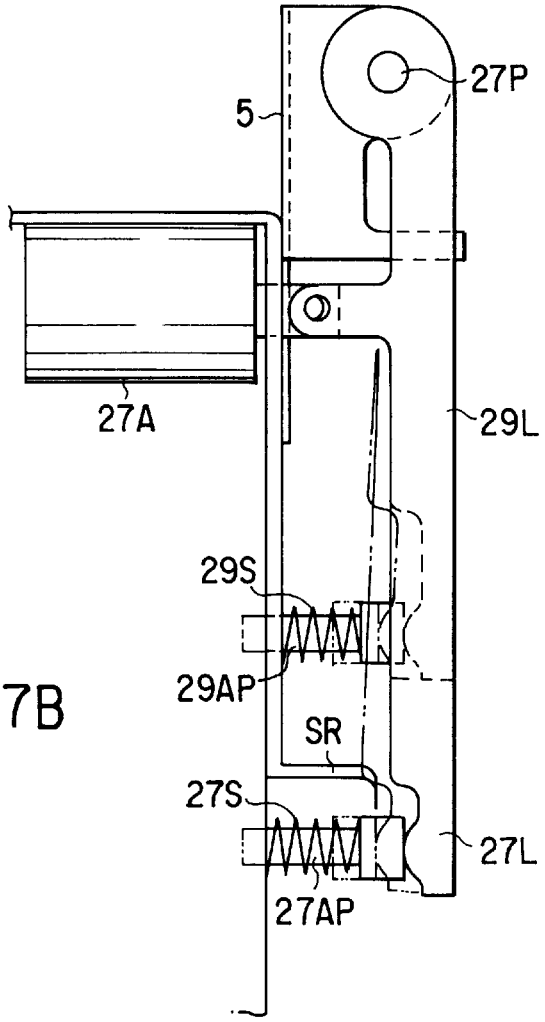

As shown in FIG. 7A, the drum 10 has its interior 16 divided by partition walls 17-1, 17-2, 17-3 and 17-4 extending in the radial direction of the drum 10, into a plurality of sections (four sections of the same size, in this embodiment). A plurality of negative pressure generating chambers (three chambers) 16-1, 16-2 and 16-3 are formed in the drum.

A plurality of suction holes 12 are made in the outer circumferential surface 11 of the drum 10, each connecting the interior and exterior of the drum 10. In the present embodiment, the suction holes 12 are formed in a region having a width less than the width of the smallest printing medium M that may be used.

Figure 8:
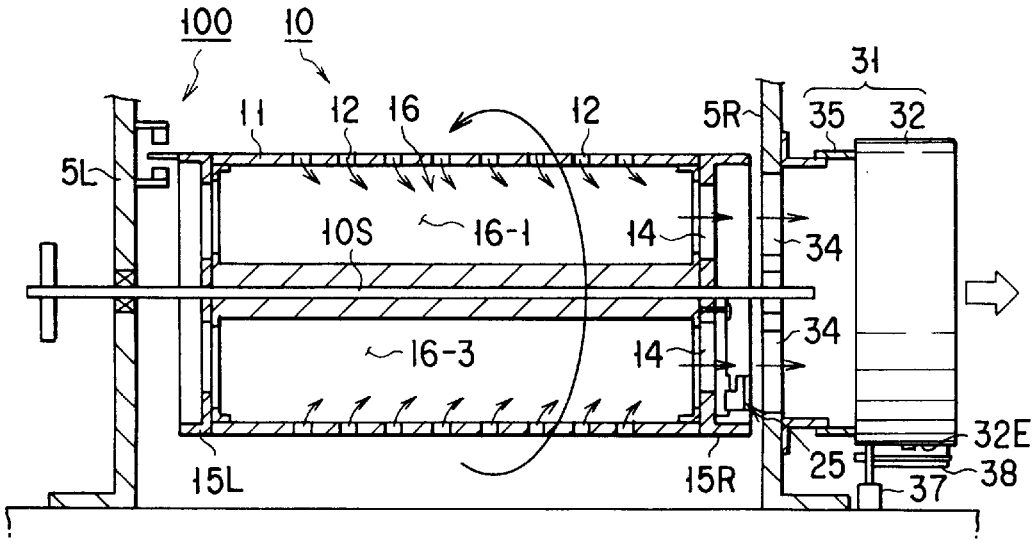
FIG. 8 is an overall view of still another embodiment of the invention.
Figure 9:
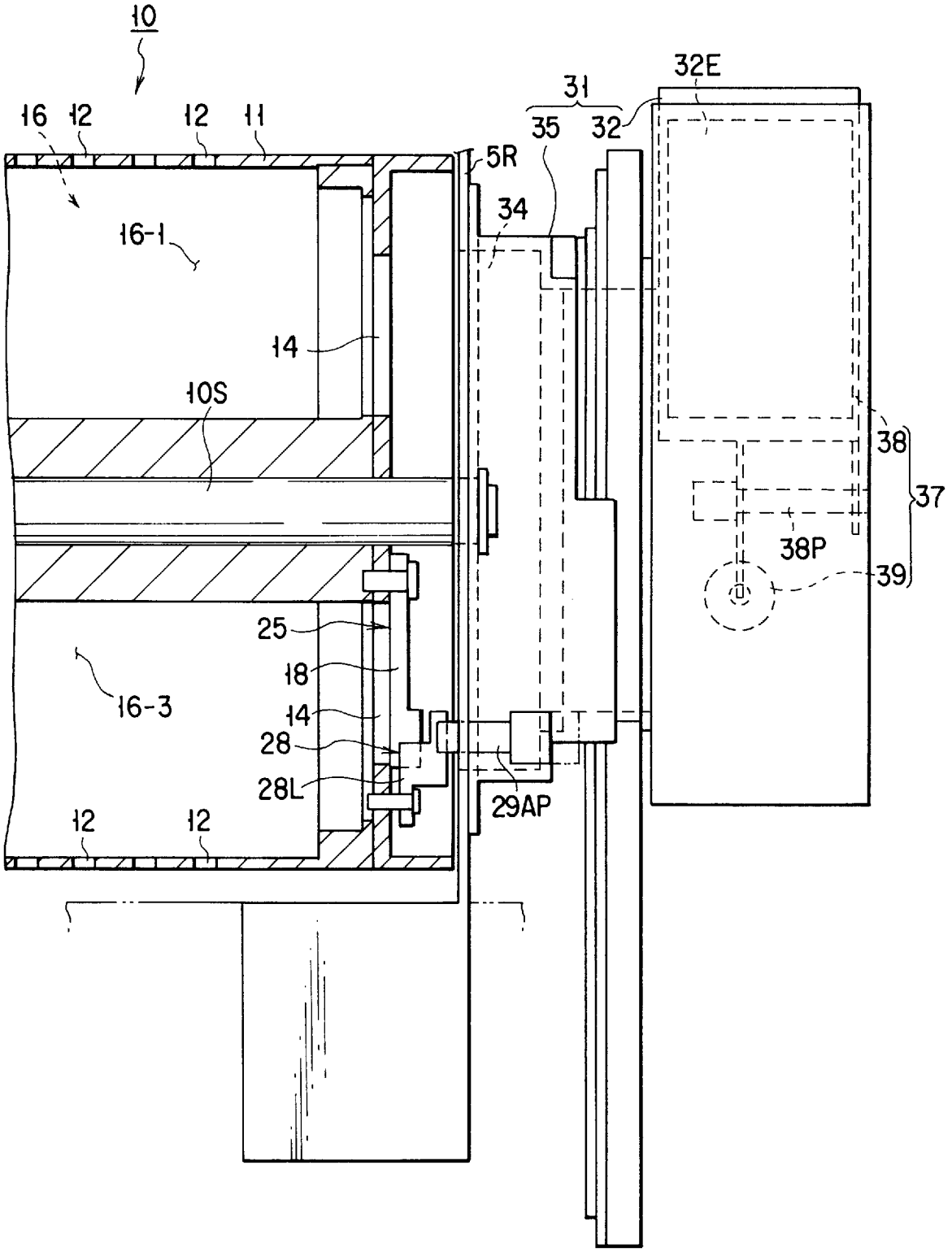
FIG. 9 is a sectional view depicting the major components of the embodiment shown in FIG. 8, in detail.

As shown in FIG. 8, a plurality of suction ports 14 are provided in one end (end plate 15R) of the drum 10, connecting the interior and exterior of the negative pressure generating chambers 16-1, 16-2 and 16-3. The total area of the suction ports 14 is set at a value greater than the total area of the suction holes 12.

Corresponding suction ports 34 are made and fixed in the bracket 5R provided in a main-body case 1, opposing the suction ports 14, respectively. The suction fan 32 is connected to the corresponding suction ports 34 of the bracket 5R by means of a duct 35.

The suction fan 32 is means for drawing air from the negative pressure generating chambers 16-1, 16-2 and 16-3 of the rotating drum 10, though the corresponding suction ports 34 and the suction ports 14, thus generating a negative pressure in each negative pressure generating chamber. This embodiment has a damper 38 that can open and close an outlet port 32E for discharging the air the suction fan 32 has drawn. The damper 38 is opened and closed by a by means of a damper opening/closing mechanism 37.

The damper 38 is located below the suction fan 32 and is supported by a pin 39P so as to be rotated. The damper opening/closing mechanism 37 is of the same type as the one illustrated in FIG. 3. It includes an actuator 39 connected to the rear end 38B of the damper 38.

The outlet port 32E of the suction fan 32 is opened when the actuator 39 is open-driven, rotating the damper 38 in clockwise direction from the closed position indicated by solid lines in FIG. 3.

The outlet port 32E of the suction fan 32 is closed when the actuator 39 is close-driven, rotating the damper 38 in counterclockwise direction back to the closed.

In the present embodiment, the suction fan 32, the duct 35 and the like constitute the negative pressure generating means 31. The drum 10 (15R) and a negative pressure generating means 31 (5R) are aligned along the axis of the drum. They are located close to each other, not contacting each other. The other end plate 15L is a blind patch.

The shutters 18 are rotatably attached to the end (end plate 15R) of the drum 10 to open and close the suction ports 14. More specifically, they are large enough to close the suction ports 14. They are supported by pins 18P at their end portions close to the center of the drum, and can rotate around the pins 18P.

As shown in FIG. 7A, the open/close mechanism 25 includes a normally closing mechanism 26, an opening mechanism 27, a releasing lock mechanism 28, and a lock releasing mechanism 29. It is designed to open the shutters 18, one after another from the downstream toward the upstream in the rotating direction of the drum 10, by utilizing the rotation of the drum 10.

The normally closing mechanism 26 is means for holding the shutters 18 normally at the positions where the shutters 18 close the suction ports 14. In this embodiment, the mechanism 26 comprises a spring 26.

The opening mechanism 27 includes an action pin 27AP, a drive lever 27L, and an actuator 27A. The mechanism 27 is designed to open the shutters 18 against the bias of the spring 26.

The releasing lock mechanism 28 includes a lock lever 28L (rotation pin 28P) and a spring 28SP. The mechanism 28 is designed to lock the shutters 18 in an opened state.

The lock releasing mechanism 29 includes an action pin 29AP a drive lever 29L, and an actuator 29A. The mechanism 29 is designed to release the shutters 18 from the open-locked state.

Hence, when the actuator 287A is driven, rotating the drive lever 27L and thereby projecting the action pin 27AP toward the end (15R) of the drum, the abutting portions 18K1 of the shutters 18 rotating along with the drum 10 abut on the action pin 27P. As a result, the shutters 18 are rotated relative to the drum 10 and are opened.

When the shutters 18 are rotated to the position indicated by two-dotted, dashed lines in FIG. 7A, the engagement sections 18KL of the shutters 18 come into engagement with the lock lever 28L, released from the engagement with the action pin 27AP. The shutters 18 are thereby locked in the open state.

When the actuator 29A is driven, rotating the drive lever 29L and thereby projecting the action pin 29AP toward the end 15R of the drum, the lock lever 28L rotating together with the drum 10 abuts on the action pin 29AP, releasing the shutters 18. The shutters 18 are therefore held in a closed state by the normally closing mechanism 26.

In FIG. 8, symbol 10S denotes the shaft of the drum 10, and numeral 100 designates the sensor for detecting the position that the drum 10 takes in its rotating direction.

The claw-type holding mechanism 41 provided as an auxiliary means is of the same type as the one shown in FIGS. 5A and 5B and FIGS. 6A and 6B.

The operation of the present embodiment will now be explained.

The damper 38 is opened as a printing medium M is supplied to the drum 10. At the same time the damper 38 is opened, the open/close mechanism 25 is operated, whereby the shutters 18 provided at the end (15R) of the drum 10 are opened sequentially, from the down-stream toward the upstream of the direction in which the drum is rotated. That is, the shutters 18 are opened sequentially, in the order opposite to the direction in which the shutters are arranged in the rotating direction.

When the shutter 18 at the downstream is opened, opening the suction port 14, the air is drawn by the suction fan 32 from the corresponding negative pressure generating chamber (16-1) to the outside through the suction port 14 thus opened. A negative pressure is thereby generated in the negative pressure generating chamber (16-1). That part of the printing medium M which has reached the position where it opposes the suction holes 12 connecting the negative pressure generating chamber (16-1) to the exterior of the drum is therefore held by virtue of the negative pressure applied through the suction holes 12.

The parts of the printing medium M, which follow the leading edge, are also held, one after another, onto the outer circumferential surface 11 of the drum, because negative pressures are generated in the other negative pressure generating chambers (16-2 and 16-3) at the upstream of the rotating direction.

Negative pressures are sequentially built up in the negative pressure generating chambers 16-1, 16-2 and 16-3, while the suction holes 12 are covered with the printing medium M. Hence, foreign substance, such as the ink in the ink jet nozzles 207, is never drawn into the chambers, and the outer circumferential surface 11 of the drum can be prevented from being contaminated.

The holding claw 42 of the claw-type holding mechanism 41 holds the leading edge of the printing medium M. Therefore, the medium M is held more reliably and firmly than otherwise, on the outer circumferential surface 11 of the drum.

The ink jet nozzles 207 for colors apply inks to the printing medium M thus held on the outer circumferential surface 11 of the drum. Color printing is thereby performed.

After the color printing, the printing medium M is no longer held by virtue of the negative pressure generated in the negative pressure generating chamber 16-1. At the same time the printing medium M is released from the attracted state, it is released also from the mechanical holding achieved by the claw-type holding mechanism 41.

As described above, the present embodiment comprises a plurality of negative pressure generating chambers 16-1, 16-2 and 16-3, suction holes 12, suction ports 14 and a plurality of shutters 18, which are provided at the drum 10. It further comprises an open/close mechanism 25 and a suction fan 32, both provided at the stationary side. The shutters 18 are opened sequentially, from the down-stream of the direction Y in which a drum 10 is rotated. Therefore, the outer circumferential surface 11 of the drum is prevented from being contaminated, a printing medium M can be held fast and reliably on the rotating drum 10, and can be released therefrom, first at its part located at the downstream of the rotating direction of the drum 10. The printing medium M can be smoothly peeled from the drum 10, first at its leading edge and finally at its trailing edge.

Even if the leading edge of the printing medium M is peeled while printing is undergoing at the part opposing the print head, printing will not be adversely influenced. This is because a negative pressure is applied to those parts of the medium M which are located at the upstream with respect to the part opposing the print head.

The total area of the suction ports 14 is greater than the total area of the suction holes 12. Hence, air is drawn from the negative pressure generating chambers 16-1, 16-2 and 16-3 of the drum 10 through the suction ports 14 in an amount larger than the air flows into the negative pressure generating chambers 16-1, 16-2 and 16-3 through the suction holes 12. Negative pressures can therefore be reliably generated in the negative pressure generating chambers 16-1, 16-2 and 16-3 of the drum 10.

A rubber roller 51 is provided as is illustrated in FIG. 4. As the drum 10 rotates, the roller 51 wipes the printing medium M held on the outer circumferential surface 11 of the drum by virtue of a negative pressure. If the printing medium M slackens, it is stretched by the rubber roller 51 before it is attracted to the outer circumferential surface 11 of the drum. No crease will therefore be formed on the printing medium M, and the medium M will firmly contact the drum 10.

Since the drum 10 (15R) and the negative pressure generating mechanism 31 (5R) do not contact, the load applied on the drum 10 while the drum 10 is rotating can be small. This ensures smooth rotation of the drum 10. The gap between the components 15R and 5R serves to reduce the difference between the load applied on the suction fan 32 when the printing medium M is held by the negative pressure and the load applied on the fan 32 when is printing medium M is not so held.

The claw-type holding mechanism 41 is used as auxiliary means for holding the leading edge of a printing medium M. The printing medium M can therefore be held onto the drum 10 more steadily and reliably than otherwise.

As described above, in the present embodiment, the interior of the drum is divided into a plurality of sections, forming a plurality of negative pressure generating chambers. And a plurality of suction holes are made, each extending in the radial direction of the drum and connecting the interior and exterior of one negative pressure generating chamber. Further, a plurality of suction ports are made in one end of the drum, each connecting the interior and exterior of one negative pressure generating chamber, and a plurality of shutters are provided at the stationary side, to open and close the suction ports. Still further, an open/close mechanism is provided, which is designed to open the shutters, one after another from the downstream toward the upstream in the rotating direction of the drum, by utilizing the rotation of the drum. Moreover, a suction fan is provided, which is designed to draw air from the negative pressure generating chambers through the suction ports opened. A printing medium can be therefore attracted to the outer circumferential surface of the drum, by virtue of the negative pressure generated in the negative pressure generating chamber. Hence, the printing medium can be held onto the rotating drum quickly and reliably and can be released therefrom after printing, while the outer circumferential surface of the drum is prevented from being contaminated.

Since the total area of the suction ports is greater than the total area of the suction holes, negative pressures can be generated in the drum more reliably than otherwise.

Furthermore, since a rubber roller is provided, which wipes the printing medium M held on the outer circumferential surface of the drum by virtue of a negative pressure, as the drum is rotated, the printing medium M is more readily prevented from wrinkling. This helps to hold the medium more firmly on the outer circumferential surface of the drum.

Figure 6A:
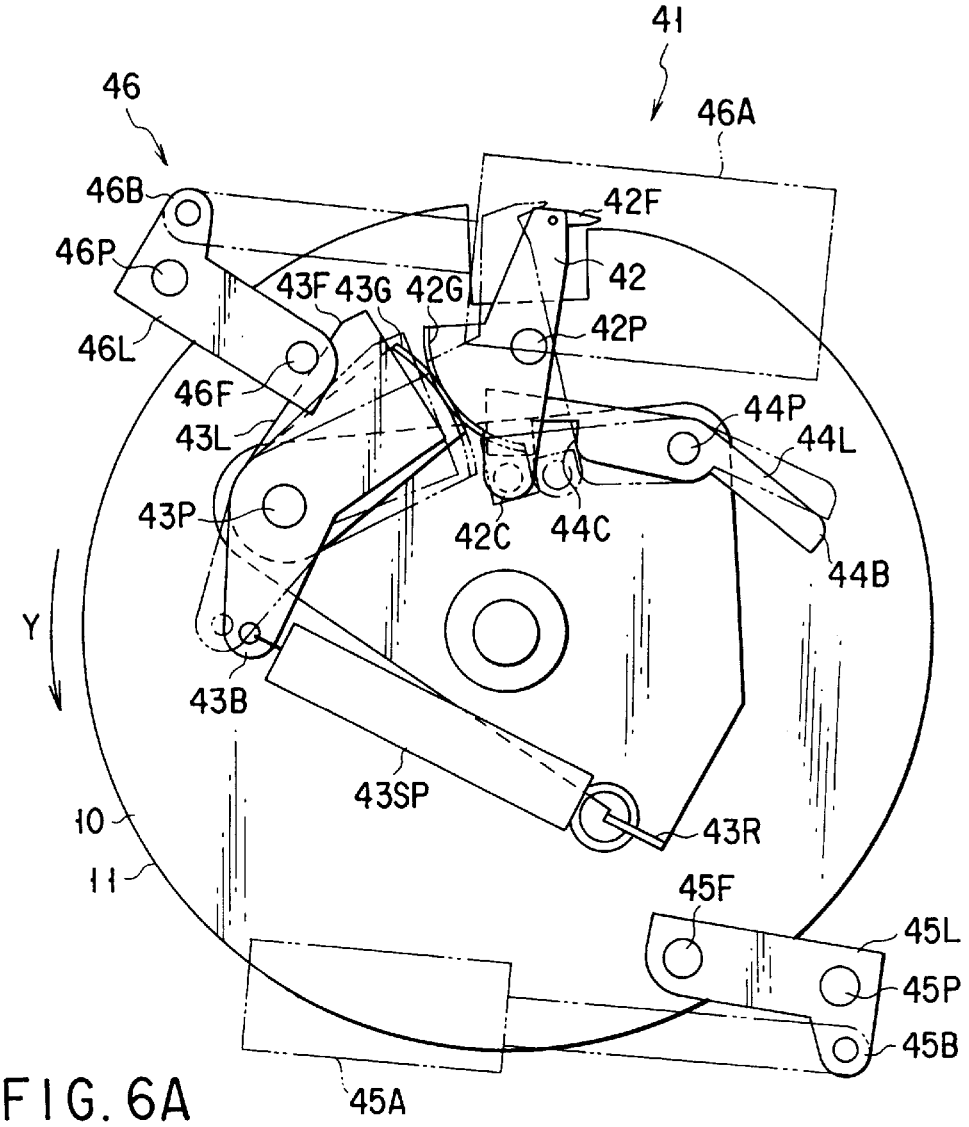
FIGS. 6A and 6B are views explaining how the holding claw used as auxiliary means is opened.
Figure 6B:
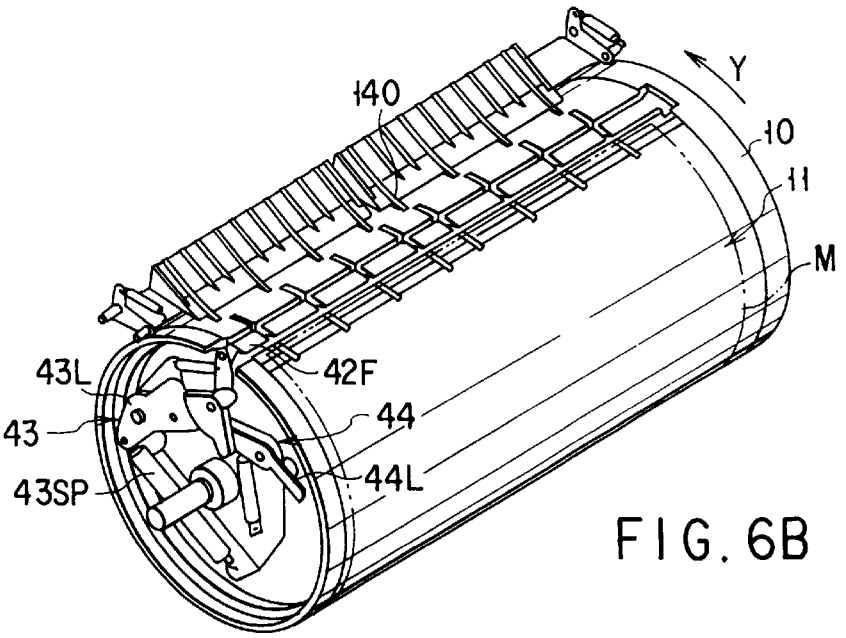

As is seen from FIGS. 5B and 6B, the normally holding mechanism 43 and the normally releasing lock mechanism 44, both operating in interlock with the holding claw 42, do not extend into the interior 16 of the drum 10, but are located more inside than the outer circumferential surface 11 of the drum. Hence, negative pressures can be reliably generated in the interior 16 of the drum, and a printing medium M can be attracted steadily by virtue of the negative pressures applied via the suction holes. In addition, the holding claw 42 or the like would not abut on the components arranged near the outer circumferential surface of the drum, such as the ink jet nozzles 207.

Since the holding claw 42 mechanically the leading edge of a printing medium M on the outer circumferential surface 11 of the drum, the medium is reliably held even its leading edge is curling. This helps prevent the jamming of the printing medium.

Still another embodiment of the present invention will be described in detail, with reference to FIG. 10A to FIG. 13.

The printing medium holding apparatus according to this embodiment, for use in ink jet printers, comprises a plurality of negative pressure generating chambers 16-1 to 16-6, suction holes 12, suction ports 14 and shutters 18-1 to 18-4, all provided at a drum 10. It further comprises an open/close mechanism 25 and a suction fan 32, both provided at a bracket 5R, or the stationary side. The shutters 18 are opened sequentially, from the down-stream of the direction Y in which the drum 10 is rotated. Negative pressures can thereby be generated in the negative pressure generating chamber 16-1 to 16-4, 16-2 and 16-3, in the order opposite to the direction in which the chambers are arranged in the rotating direction Y. Printing media M1 to M5 arbitrarily selected can be reliably attracted, by virtue of negative pressures, to the outer circumferential surface 11 of the drum.

The printing media M1 to M5 selected are, for example, B5 sheets (M1), EXEC sheets (M2), A5 sheets (M3), A4 sheets (M4), and LETTER sheets (M5).

The negative pressure generating chambers 16-1, and the suction holes 12 are formed in accordance with the lengths of the printing media.

In the present embodiment, mechanical holding is adopted as auxiliary means for holding paper sheets.

The interior 16 of the drum 10 is divided into a plurality of sections (seven sections in the present embodiment) by partition walls 17-1, 17-2, 17-3, 17-4, 17-5, 17-6 and 17-7, for the kinds of printing media M. All sections but one (i.e., six sections) are used as a plurality of negative pressure generating chambers 16-1, 16-2, 16-3, 16-4, 17-5 and 16-6.

A plurality of suction holes 12 are made in the outer circumferential surface of the drum 10 in accordance with the lengths of the printing media M. The holes 12 connect the interior and exterior of the negative pressure generating chambers 16-1 to 16-6. In this embodiment, the suction holes 12 are formed in a region having a width less than the width of the smallest printing medium M that may be used.

Figure 11:
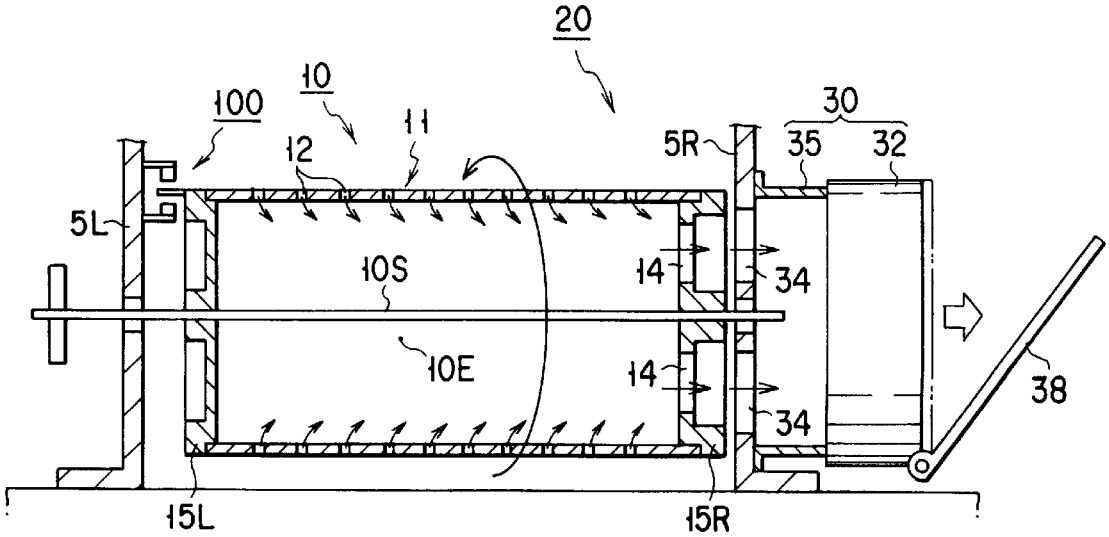
FIG. 11 is a sectional view illustrating the internal structure of the drum incorporated in still another embodiment.
Figure 13:
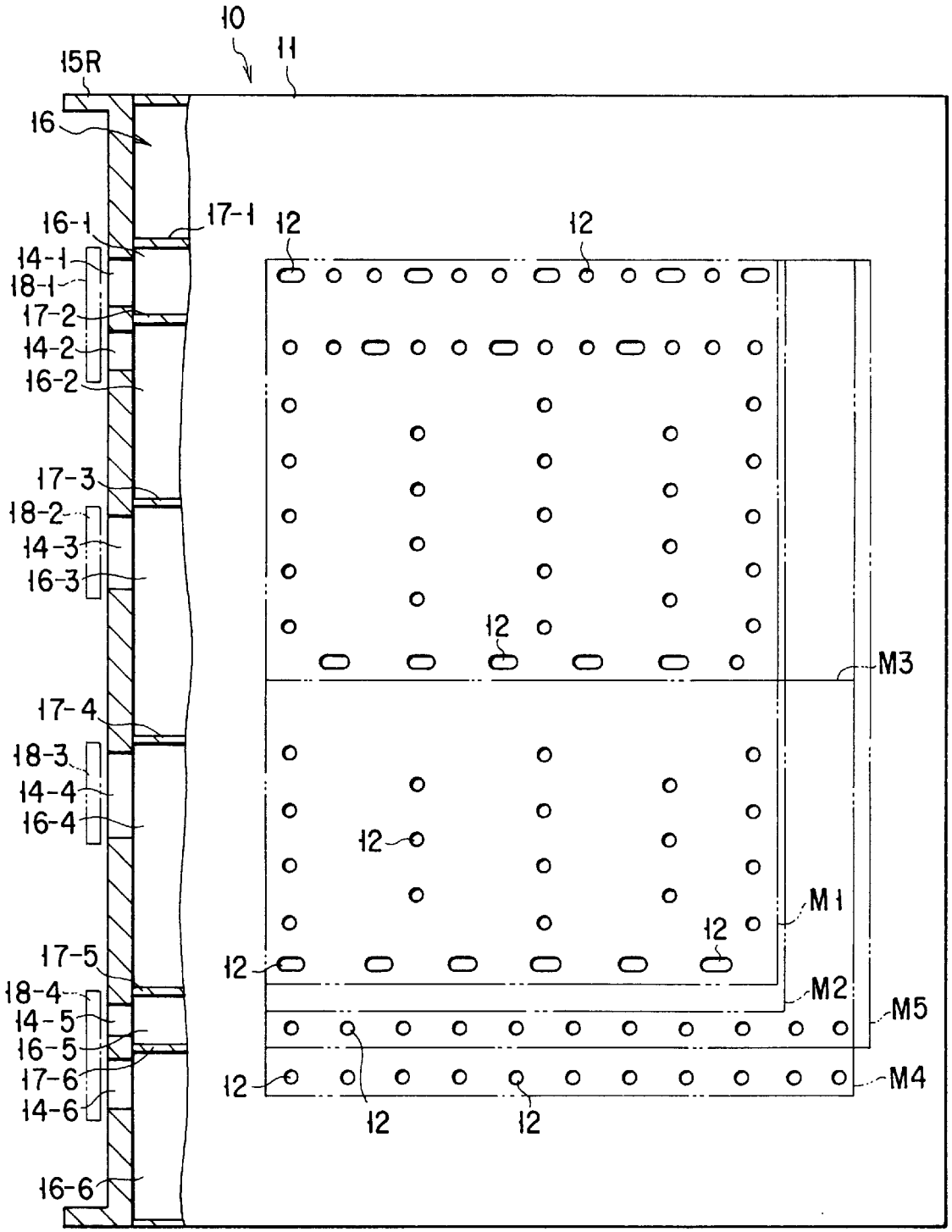
FIG. 13 is a view for explaining the positional relationship of each negative pressure generating chamber, the suction ports and the shutter, all provided in the embodiment of FIG. 11.

As shown in FIG. 11, a plurality of suction ports 14 are provided in one end (end plate 15R) of the drum 10, connecting the interior and exterior of the negative pressure generating chambers 16-1 to 16-6. The total area of the suction ports 14 is set at a value greater than the total area of the suction holes 12.

Corresponding suction ports 34 are made and fixed in the bracket 5R provided in a main-body case 1, opposing the suction ports 14, respectively. The suction fan 32 is connected to the corresponding suction ports 34 of the bracket 5R by means of a duct 35.

The suction fan 32 is means for drawing air from the negative pressure generating chambers 16-1 to 16-6 of the rotating drum 10, though the corresponding suction ports 34 and the suction ports 14, thus generating negative pressures in the negative pressure generating chambers 16-1 to 16-6. This embodiment has a damper 38 that can open and close an outlet port 32E for discharging the air the suction fan 32 has drawn.

In the present embodiment, the suction fan 32, the duct 35 and the like constitute the negative pressure generating means 31. The drum 10 (15R) and a negative pressure generating means 30 (5R) are aligned along the axis of the drum. They are located close to each other, not contacting each other. The other end plate 15L is a blind patch.

The shutters 18-1, 18-2, 18-3 and 18-4 are rotatably attached to the end (end plate 15R) of the drum 10 to open and close the suction ports 14.

More specifically, the shutter 18-1 is used to open and close two adjacent suction ports 14-1 and 14-2. It is designed to open and close the suction ports 14-1 and 14-2 sequentially, from the downstream toward upstream of the rotating direction of the drum. Similarly, the shutter 18-4 is used to open and close two adjacent section ports 14-5 and 14-6. The shutter 18-2 is provided to open and close one suction port 14-3 (14-4).

The shutters 18-1, 18-2, 18-3 and 18-4 are large enough to open and close the suction ports 14-1 and 14-2, the suction port 14-3, the suction ports 14-5 and 14-6, respectively. They are supported by a pin 18P at their end portions close to the center of the drum 10, and can rotate around the pins 18P.

The open/close mechanism 25 includes a normally closing mechanism 26, an opening mechanism 27, a releasing lock mechanism 28, and a lock releasing mechanism 29. It is designed to open the shutters 18, one after another from the downstream toward the upstream in the rotating direction of the drum 10, by utilizing the rotation of the drum 10.

The normally closing mechanism is means for holding the shutter 18-1, etc. normally at the positions where the shutters 18-1, etc.,. close the suction ports 14. In this embodiment, the mechanism 26 comprises a spring 26. The opening mechanism 27 includes an action pin 27AP, a drive lever 27L, and an actuator 27A. It is designed to open the shutters 18 against the bias of the spring 26.

The releasing lock mechanism 28 includes a lock lever 28L (rotation pin 28P) and a spring 28SP. The mechanism 28 is designed to lock the shutter 18-1 and the like in an opened state. The lock releasing mechanism 29 includes an action pin 29AP a drive lever 29L, and an actuator 29A. The mechanism 29 is designed to release the shutter 18-1, etc., from the open-locked state.

Hence, when the actuator 287A is driven, rotating the drive lever 27L and thereby projecting the action pin 27AP toward the end 15R of the drum, the abutting portions 18K1 of the shutter 18-1, etc., rotating along with the drum 10 abut on the action pin 27P. As a result, the shutter 18-1, etc. are rotated relative to the drum 10 and are opened.

Figure 10A:
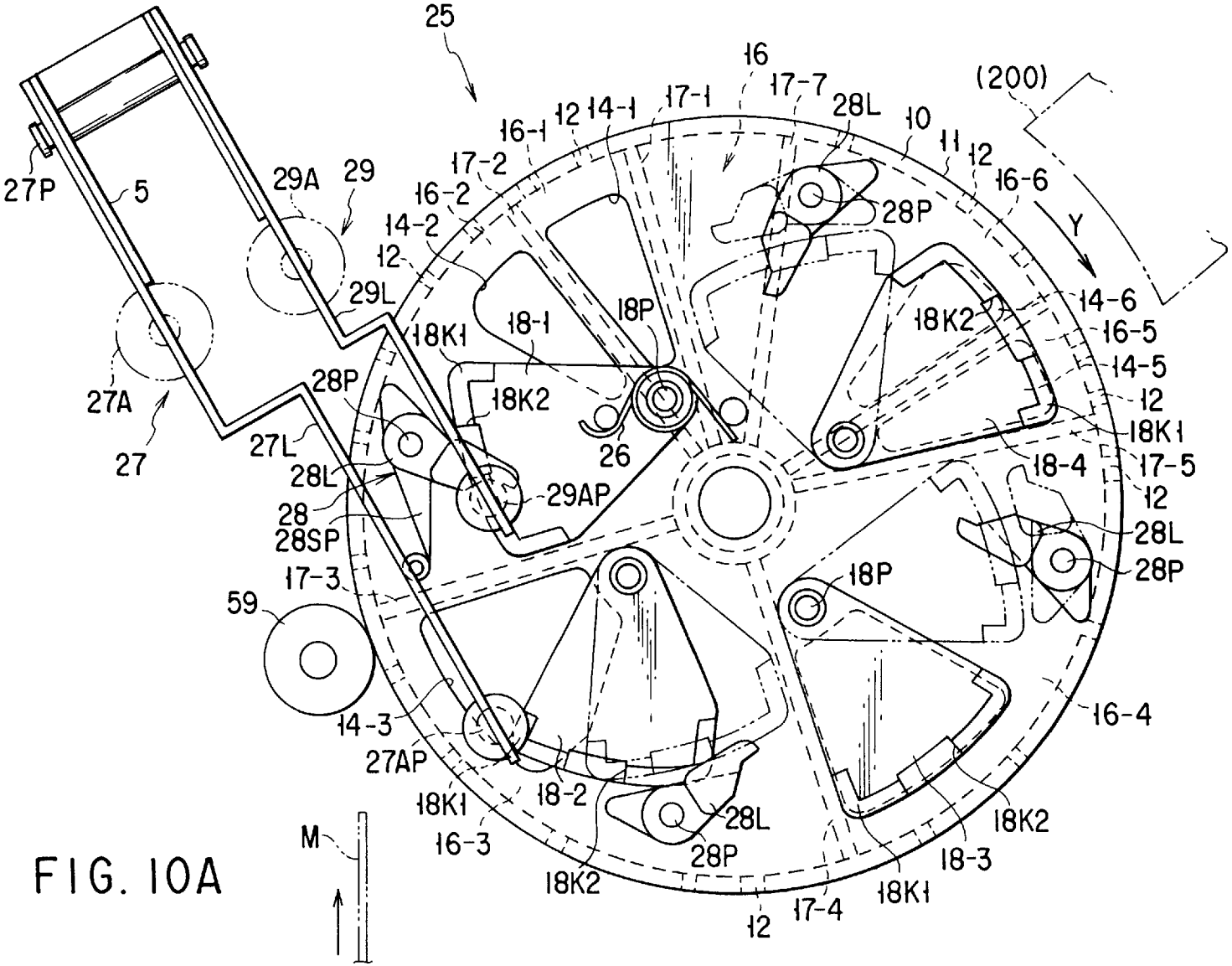
FIGS. 10A and 10B are views showing one end of the drum incorporated in another embodiment of the present invention.
Figure 12:
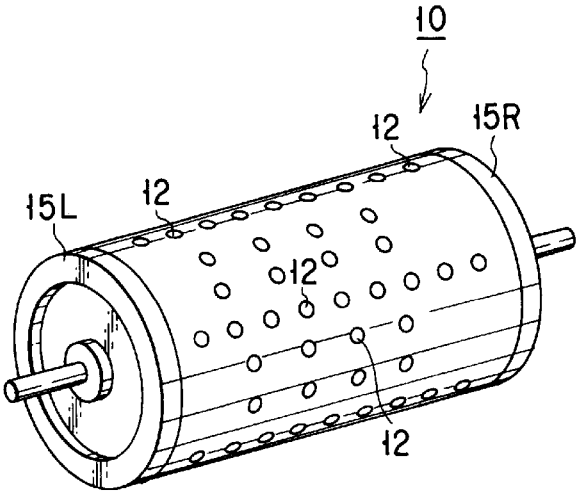
FIG. 12 is a perspective view representing the outer appearance of the drum provided in the embodiment shown in FIG. 11.
Figure 10B:
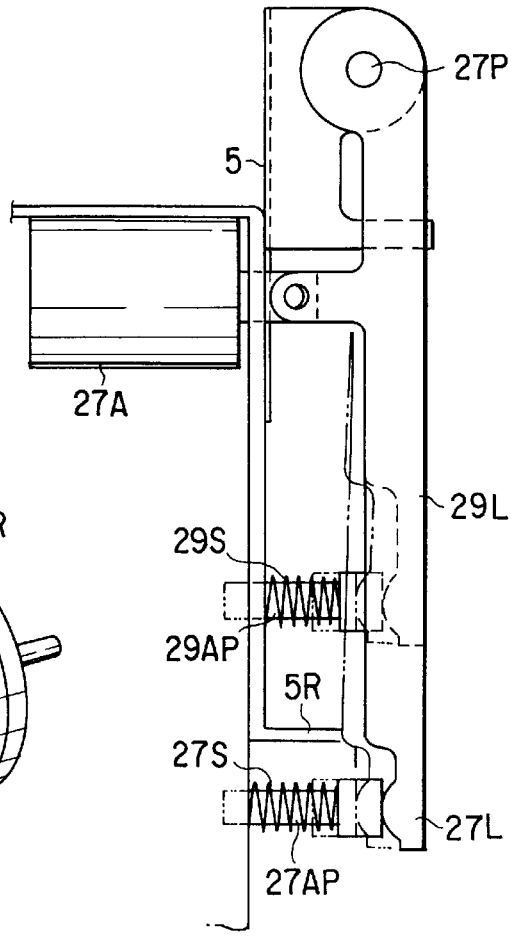

When the shutter 18-1, etc. are rotated to the position indicated by two-dotted, dashed lines in FIG. 10A, the engagement sections 18K2 of the shutter 18-1, etc., come into engagement with the lock lever 28L, released from the engagement with the action pin 27AP. The shutter 18-2, etc., are thereby locked in the open state.

When the actuator 29A is driven, rotating the drive lever 29L and thereby projecting the action pin 29AP toward the end 15R of the drum, the lock lever 28L rotating together with the drum 10 abuts on the action pin 29AP, releasing the shutters 18. The shutter 18-1, etc., are therefore held in a closed state by the normally closing mechanism 26.

In FIGS. 10A, numeral 59 denotes a wiping roller. The wiping roller 59 can move to contact the outer circumferential surface 11 of the drum and can move away therefrom. The roller 59 is designed to wipe the printing medium M attracted to the outer circumferential surface 11 by virtue of a negative pressure, from the leading edge of the medium M toward the trailing edge thereof, as the drum 10 is rotated. If the printing medium M slackens, it is stretched by the wiping roller 59. Hence, the printing medium M would not wrinkle while held on the outer circumferential surface 11 of the drum. The wiping roller 59 is removed from the outer circumferential surface 11 of the drum before printing is started. Ink is therefore prevented from being transferred to the roller 59 from the printing medium M.

In FIG. 11, symbol 10S denotes the shaft of the drum 10, and numeral 100 designates the sensor for detecting the position that the drum 10 takes in its rotating direction.

The operation of the present embodiment will now be explained.

As a printing medium selected, e.g., a printing medium M1, is supplied to the drum 10, the damper 38 is opened and the open/close mechanism 25 is driven. The shutters 18-1, 18-2, 18-3 and 18-4 provided at the end 15R of the drum 10 are thereby opened sequentially, from the downstream toward the upstream of the rotating direction (direction Y) of the drum. That is, the shutters 18-1, 18-2, 18-3 and 18-4 are opened one after another in the order opposite to the direction in which they are arranged in the rotating direction.

When the shutter 18-1 at the downstream is opened, thus opening the suction port 14-1, air is drawn from the negative pressure generating chamber 16-1 by the suction fan 32. A negative pressure is thereby generated in the negative pressure generating chamber 16-1. As a result, that part (leading edge) of the printing medium M which has reached a position opposing the section holes 12 communicating the negative pressure generating chamber 16-1 is held by the negative pressure applied through the suction holes 12.

The parts of the printing medium M, which follow the leading edge, are also held, one after another, onto the outer circumferential surface 11 of the drum, because negative pressures are generated in the other negative pressure generating chambers (16-2, 16-3, 16-4, 16-5, 16-6) at the upstream of the rotating direction.

The suction holes 12 communicating with the negative pressure generating chambers 16-1 to 16-6 are covered with the printing medium M. Therefore, foreign substance, such as the ink in the ink jet nozzles 207, is never drawn into the chambers, and the outer circumferential surface 11 of the drum can be prevented from being contaminated.

The ink jet nozzles 207, each provided for a color, apply inks to the printing medium M held on the outer circumferential surface 11 of the drum. Color printing is thereby accomplished.

After the color printing, the printing medium M is released from the attraction achieved by the negative pressures and, at the same time, from the mechanical holding effected by the claw-type holding mechanism 41. As mentioned above, the present embodiment has a plurality of negative pressure generating chambers 16-1 to 16-6, suction holes 12, suction ports 14 and shutters 18, all provided at the drum 10, and an open/close mechanism 25 and a suction fan 32 at the stationary side. The negative pressure generating chambers 16-1 to 16-6 and the suction holes 12 are formed in accordance with the lengths of the printing media, to hold any printing medium selected from the media of different sizes (M1 to M5) on the outer circumferential surface 11 of the drum by virtue of the negative pressures generated in the negative pressure generating chambers 16-1 to 16-6. Therefore, negative pressures are generated in the negative pressure generating chambers 16-1 to 16-6 while the suction holes 12 are covered with the printing medium selected.

Hence, ink would not be drawn from, for example, the outlet ports of the ink jet nozzles 207 through the suction holes 12. The outer circumferential surface 11 of the drum will not be contaminated.

Since the negative pressure generating chambers 16-1 to 16-6 and the suction holes 12 are formed in accordance with the lengths of the printing media M1 to M5, any printing medium selected can be reliably held by virtue of negative pressure.

Further, the total area of the suction ports 14 is set at a value greater than the total area of the suction holes 12. Hence, air is drawn from the negative pressure generating chambers 16-1 to 16-6 of the drum 10 through the suction ports 14 in an amount larger than the air flows into the negative pressure generating chambers 16-1 to 16-7 through the suction holes 12. Negative pressures can therefore be more reliably generated in the negative pressure generating chambers 16-1 to 16-6 of the drum 10 than otherwise.

Still further, the wiping roller 51 can contact the outer circumferential surface 11 of the drum, for wiping the printing medium (e.g., M1) held on the surface 11 by virtue of negative pressure, as the drum 10 is rotated. The wiping roller 51 stretches the printing medium (e.g., M1) if the medium slackens. The printing medium (e.g., M1) will have no crease and will be firmly held onto the surface 11.

Since the drum 20 (15R) and the negative pressure generating mechanism 31 (5R) do not contact, the rotation load on the drum 10 can be decreased. This ensures a smooth rotation of the drum 10. The gap between the components 15R and 5R serves to reduce the difference between the load applied on the suction fan 32 when the printing medium (e.g., M1) is held by the negative pressure and the load applied on the fan 32 when the printing medium is not so held.

As described above, in the present embodiment, the interior of the drum is divided into a plurality of sections, forming negative pressure generating chambers. And a plurality of suction holes are provided, each extending in the radial direction of the drum and connecting the interior and exterior of one negative pressure generating chambers. Further, a plurality of suction ports are made in one end of the drum, each connecting one negative pressure generating chamber and the exterior of the drum, and a plurality of shutters are provided to open and close the suction ports. Still further, an open/close mechanism is provided, which is designed to open the shutters, one after another from the downstream toward the upstream in the rotating direction of the drum, by utilizing the rotation of the drum. Moreover, a suction fan is provided, which is designed to draw air from the negative pressure generating chambers through the suction ports opened. The negative pressure generating chambers and the suction holes are designed in accordance with the lengths of printing media of different lengths, so that any printing medium selected from the media of different lengths may be attracted to the outer circumferential surface of the drum by virtue of the negative pressures in the negative pressure generating chambers. Hence, the printing medium selected can be held onto the rotating drum quickly and reliably and released therefrom after printing, while the outer circumferential surface of the drum is prevented from getting dirty with ink.

Since two adjacent suction ports can be opened and closed by one shutter, they can be sequentially opened (and closed) more smoothly and accurately than otherwise. The number of components required is reduced, whereby the apparatus can be made smaller and can be manufactured at a lower cost.

In this invention, a roller is provided which can contact and can be removed from the outer circumferential surface of the drum and which can wipe the printing medium held on the outer circumferential surface of the drum by virtue of negative pressure, from the leading edge of the printing medium to the trailing edge thereof. The roller prevents the printing medium from wrinkling, and the medium can be held onto the outer circumferential surface of the drum.

Furthermore, since the total area of the suction ports is greater than the total area of the suction holes, the medium holding apparatus for use in ink jet printers can generate negative pressures in the interior of the drum more reliably than otherwise.

What is claimed is:

1. A printing medium holding apparatus for use in an ink jet printer designed to effect printing by applying ink from ink nozzles onto a printing medium held on a drum rotating at a prescribed circumferential speed and thus rotating together with the drum, said apparatus comprising:

a plurality of negative pressure generating chambers formed by dividing an interior of the drum into a plurality of sections, by using partition walls which extend in a radial direction;

a plurality of suction holes in said negative pressure chambers, extending in a radial direction, and connecting the interior and exterior of the drum;

a plurality of suction ports in one end of the drum and connecting said negative pressure generating chambers and an exterior thereof;

shutters arranged to open and close said suction ports;

an open/close mechanism provided at a stationary side for opening and closing said shutters sequentially from downstream toward upstream of a rotating direction of the drum, by utilizing rotation of the drum; and a suction fan for drawing air from the negative pressure generating chambers through said suction ports when said suction ports are opened, wherein the printing medium is held onto an outer circumferential surface of the drum by virtue of negative pressures generated in said negative pressure generating chambers.

2. A printing medium holding apparatus for use in an ink jet printer, according to claim 1, wherein:

a total area of said suction ports is greater than a total area of said suction holes.

3. A printing medium holding apparatus for use in an ink jet printer, according to claim 2, wherein:

a rubber roller is provided for wiping, as the drum rotates, the printing medium held on the outer circumferential surface of the drum by virtue of the negative pressures, from a leading edge of the printing medium toward a trailing edge of the printing medium.

4. A printing medium holding apparatus for use in an ink jet printer, according to claim 1, wherein:

a rubber roller is provided for wiping, as the drum rotates, the printing medium held on the outer circumferential surface of the drum by virtue of the negative pressures, from a leading edge of the printing medium toward a trailing edge of the printing medium.

5. A printing medium holding apparatus for use in an ink jet printer designed to effect printing by applying ink from ink nozzles onto a printing medium held on a drum rotating at a prescribed circumferential speed and thus rotating together with the drum, said apparatus comprising:

a plurality of negative pressure generating chambers formed by dividing an interior of the drum into a plurality of sections, by using partition walls which extend in a radial direction;

a plurality of suction holes in said negative pressure chambers, extending in a radial direction, and connecting the interior and exterior of the drum;

a plurality of suction ports in one end of the drum and connecting said negative pressure generating chambers and an exterior thereof;

shutters arranged to open and close said suction ports;

an open/close mechanism provided at a stationary side for opening and closing said shutters sequentially from downstream toward upstream of a rotating direction of the drum, by utilizing rotation of the drum;

a suction fan for drawing air from the negative pressure generating chambers through said suction ports when said suction ports are opened; and a holding device having a holding claw for holding, onto an outer circumferential surface of the drum, edge parts of the printing medium which are attracted to the circumferential surface of the drum by virtue of negative pressures generated in said negative pressure generating chambers.

6. A printing medium holding apparatus for use in an ink jet printer, according to claim 5, wherein:

said holding claw is provided on an inside part of the drum; and an action member for causing said holding claw to hold and release the printing medium is provided on the inside part of the drum.

7. A printing medium holding apparatus for use in an ink jet printer designed to effect printing by applying ink from ink nozzles onto a printing medium held on a drum rotating at a prescribed circumferential speed and thus rotating together with the drum, said apparatus comprising:

a plurality of negative pressure generating chambers formed by dividing an interior of the drum into a plurality of sections, by using partition walls which extend in a radial direction;

a plurality of suction holes in said negative pressure chambers, extending in a radial direction, and connecting the interior and exterior of the drum;

a plurality of suction ports in one end of the drum and connecting said negative pressure generating chambers and an exterior thereof;

shutters arranged to open and close said suction ports;

an open/close mechanism for opening and closing said shutters sequentially from downstream toward upstream of a rotating direction of the drum, by utilizing rotation of the drum; and a suction fan for drawing air from the negative pressure generating chambers through said suction ports when said suction ports are opened;

wherein said negative pressure generating chambers and said suction holes are designed in accordance with lengths of kinds of printing media having different lengths, so that any printing medium selected may be held onto an outer circumferential surface of the drum by virtue of negative pressures generated in said negative pressure generating chambers.

8. A printing medium holding apparatus for use in an ink jet printer, according to claim 7, wherein:

any adjacent two of said suction ports are opened and closed by one shutter, sequentially, from the downstream toward the upstream of the rotating direction of the drum.

9. A printing medium holding apparatus for use in an ink jet printer, according to claim 8, wherein:

a wiping roller is provided which is movable to contact and leave the outer circumferential surface of the drum, to wipe the printing medium attracted to the outer circumferential surface by virtue of the negative pressures, from a leading edge of the medium toward a trailing edge of the medium.

10. A printing medium holding apparatus for use in an ink jet printer, according to claim 9, wherein:

a total area of said suction ports is greater than a total area of said suction holes.

11. A printing medium holding apparatus for use in an ink jet printer, according to claim 8, wherein:

a total area of said suction ports is greater than a total area of said suction holes.

12. A printing medium holding apparatus for use in an ink jet printer, according to claim 7, wherein:

a wiping roller is provided which is movable to contact and leave the outer circumferential surface of the drum, to wipe the printing medium attracted to the outer circumferential surface by virtue of the negative pressures, from a leading edge of the medium toward a trailing edge of the medium.

13. A printing medium holding apparatus for use in an ink jet printer, according to claim 12, wherein:

a total area of said suction ports is greater than a total area of said suction holes.

14. A printing medium holding apparatus for use in an ink jet printer, according to claim 7, wherein:

a total area of said suction ports is greater than a total area of said suction holes.

* * * * *